United States Patent [19]

Kamat

[11] Patent Number: 4,737,396

[45] Date of Patent: Apr. 12, 1988

[54] COMPOSITE FUSIBLE INTERLINING FABRIC

[75] Inventor: Dattatraya V. Kamat, Yardley, Pa.

[73] Assignee: Crown Textile Company, Jenkintown, Pa.

[21] Appl. No.: 10,625

[22] Filed: Feb. 4, 1987

[51] Int. Cl.[4] ..... B32B 3/06; B32B 7/14; B32B 31/20; A41D 27/06

[52] U.S. Cl. ..... 428/197; 2/97; 2/272; 156/148; 156/291; 427/288; 428/198; 428/246; 428/248; 428/249; 428/253; 428/257; 428/359

[58] Field of Search ..... 2/97, 272; 156/148, 156/291; 427/288; 428/197, 198, 246, 248, 249, 253, 257, 359

[56] References Cited

U.S. PATENT DOCUMENTS 4,450,196 5/1984 Kamat ..... 428/197

*Primary Examiner*—James C. Cannon

*Attorney, Agent, or Firm*—Robert C. Podwil

[57] ABSTRACT

A composite fusible interlining fabric is provided. The fabric comprises a nonwoven layer and a fibrous layer stitched together. A coating of thermoactive adhesive material is disposed on the outer face of the fibrous layer.

22 Claims, 1 Drawing Sheet

FIG. 1
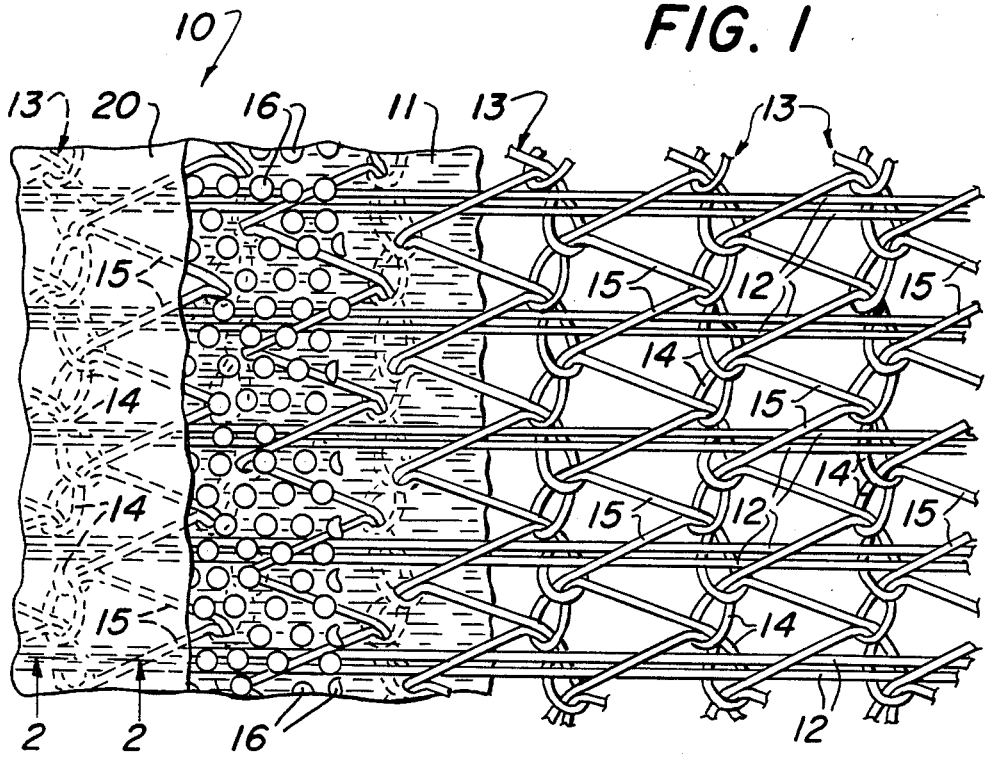
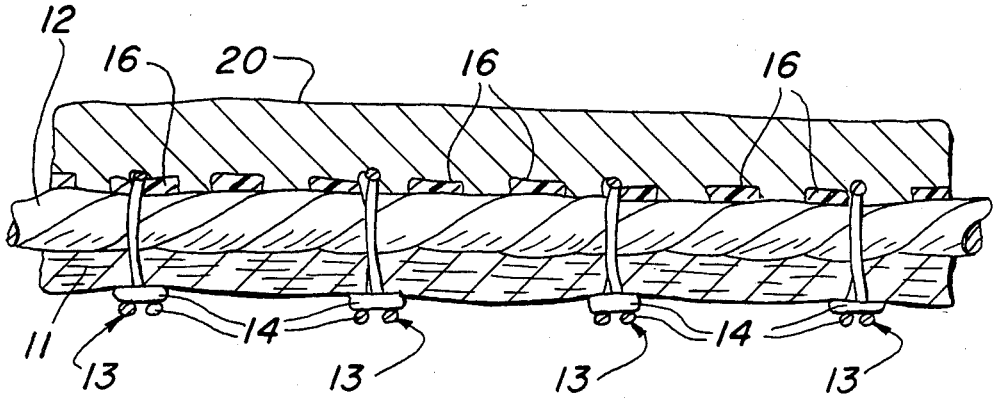
FIG. 2

COMPOSITE FUSIBLE INTERLINING FABRIC

BACKGROUND

U.S. Pat. No. 4,450,196, issued May 22, 1984 to Kamat discloses a composite fusible interlining fabric formed from a layer of nonwoven fabric, a layer of fibrous material positioned against one side of the nonwoven fabric, stitch yarn knit through the two layers to secure the layers together, and a coating of thermoactive adhesive material on the side of the nonwoven layer not in contact with the layer of fibrous material. The patent discloses that the layer of nonwoven fabric provides a smooth surface for the coating of the adhesive and acts as an effective barrier to prevent so-called strike back of the adhesive when the composite interlining fabric is fused to the base or garment fabric.

The composite interlining fabric made in accordance with the teachings of U.S. Pat. No. 4,450,196 suffers from several disadvantages in specific contexts. For example, when the interlining is fused to relatively thin, lightweight, tightly woven garment fabrics such as poplin, seersucker and pinfeather, the garment fabrics have a tendency to pucker when the fused fabric is rolled about an axis defined by the stitch loop chains formed by the stitch yarn. In addition, in some applications, particularly those in which the interlining fabric is fused to relatively soft fabrics such as wool and polyester/wool of the type used to make suits, skirts and similar items of clothing, the fused fabric has an insufficient amount of resilience. Typical examples include the front piece and inner chest piece of suit jackets. Accordingly, there is a need in the art for a composite interlining fragment which can be thermally fused to (1) thin, tightly woven garment fabrics such as poplin, seersucker and the like to produce a fused fabric which is immune from puckering when rolled, and (2) soft, pliable fabrics to impart a high degree of resilience to the fused fabric.

SUMMARY OF THE INVENTION

This need is met by the present invention which is a composite fusible interlining fabric adapted to be fused to a base fabric and characterized by the smooth surface characteristics of nonwoven interlining fabric and the strength, bulk, resiliency and drapability characteristics of woven and knit interlining fabrics, said interlining fabric comprising a layer of nonwoven fabric of closely compacted fibers, a layer of inlaid weft yarns positioned against one side of said layer of nonwoven fabric, stitch yarn knit through said layer of nonwoven fabric and said layer of inlaid weft yarns and securing said inlaid weft yarns to said layer of nonwoven fabric, and a coating of thermoactive adhesive material on the side of the interlining fabric on which said layer of inlaid weft yarns is positioned, said coating of thermoactive adhesive material being fusible at a predetermined temperature which is lower than the temperature at which said layer of nonwoven fabric, said layer of inlaid weft yarns, said knit stitch yarn and the base fabric will be adversely affected, so that said composite interlining fabric may be fused to one side of the base fabric by the application of heat thereto, said layer of nonwoven fabric providing a barrier to prevent strike back of said adhesive coating material when said composite interlining fabric is fused to the base fabric.

BRIEF DESCRIPTION OF THE DRAWINGS

FIG. 1 is a fragmentary, elevational view of a garment base fabric with the composite fusible interlining fabric of the present invention fused to the rear surface thereof and with the different components of the interlining fabric being broken away to illustrate the construction thereof.

FIG. 2 is a greatly enlarged sectional view taken substantially along the line 2—2 in FIG. 1.

DETAILED DESCRIPTION

With reference to the drawings wherein reference numerals are used to indicate correspondingly numbered elements in the written description, there can be seen a fused composite fabric indicated generally by 10.

The composite fusible interlining fabric of the present invention illustrated in FIGS. 1 and 2 includes a relatively thin layer of nonwoven fabric 11, formed of closely compacted fibers, and a layer of fibrous material, illustrated as inlaid weft yarns 12. The weft yarn may be spun yarn, multifilament yarn or monofilament yarn, depending upon the specific application of the interlining fabric. Stitch yarn, broadly indicted at 13, is knit in a warp knit stitch pattern through the layer of nonwoven fabric 11 and incorporates the inlaid weft yarns 12 therein. The stitch yarn 13 forms a plurality of side-by-side walewise extending stitch loop chains 14 on the front or face side of the composite fusible interlining fabric. The laps 15 extend in a zig zag path between adjacent wales of stitch loop chains 14. Thus, the stitch yarn 13 is knit through and connects the layer of nonwoven fabric with the layer of fibrous material (yarn 12) and provides the strength, bulk, drapability and resiliency characteristics of conventional knit or woven interlining fabric. The layer of nonwoven fabric 11 provides the smooth surface characteristics of conventional nonwoven interlining fabric.

A coating of thermoactive adhesive material is illustrated as being applied to the side of the composite interlining fabric containing the inlaid weft yarns 12. The coating of thermoactive adhesive material may be applied in any desired manner, such as the randomly arranged dots 16 of the adhesive material shown in FIG. 1. The diameter and thickness of the dots 16 of thermoactive adhesive material have been greatly exaggerated in FIGS. 1 and 2. In the actual fabric, the dots of adhesive material are substantially invisible. The adhesive not only bonds the interlining fabric to the garment fabric, but also secures the weft yarns to the interlining fabric itself. In the absence of such adhesive, the weft yarns have a strong tendency to pull out from under the stitch yarn of the interlining fabric construction.

The garment or base fabric, indicated at 20, is fused or bonded to the composite fusible interlining fabric by the application of heat and pressure to soften the dots 16 of adhesive or fusible material and to cause the same to adhere to the inner surface of the garment base fabric 20. The provision of the layer of nonwoven fabric 11 in the composite interlining fabric provides a barrier or shield of closely compacted fibers to prevent strike back of the thermoactive adhesive coating material when the composite interlining fabric is fused to the base fabric. The inlaid weft yarn 12 provides the desired resiliency, bulk, hand, body, drape and other characteristics to the fused garment.

The coating of thermoactive adhesive material is fusible at a predetermined temperature which is lower than the temperature at which the other materials in the interlining fabric will be adversely affected so that the heat and pressure applied during the fusing of the interlining fabric to the base fabric will not affect the other materials of the interlining fabric. The composite fusible interlining fabric of the present invention permits the interlining manufacturer to economically form a wide variety of interlining fabrics with the proper characteristics for attachment to a wide variety of different types of garment fabrics. For example, when the interlining fabric is to be fused to poplin to form pucker-free rainwear garments, the weft yarn can be from about 10/1 to about 30/1 cotton count yarn, preferably made from 100% polyester.

When the interlining fabric must have a high degree of resilience to form shaped garment pieces such as the front piece or the inner chest piece of suit jackets, monofilament weft yarns are preferred. Suitable monofilament yarns are in the range from about 85 to 550 denier. Suitable materials include polyester and nylon. In suit jacket front piece construction, 85 to 550 denier yarns are preferred. In suit jacket chest piece construction, 150 to 550 denier yarns are preferred.

It will be understood that the specific embodiments described herein are illustrative only, and that the invention is defined by the appended claims.

What is claimed is:

1. A composite fusible interlining fabric adapted to be fused to a base fabric and characterized by the smooth surface characteristics of nonwoven interlining fabric and the strength, bulk, resiliency and drapability characteristics of woven and knit interlining fabrics, said interlining fabric comprising a layer of nonwoven fabric of closely compacted fibers, a layer of inlaid weft yarns positioned against one side of said layer of nonwoven fabric, stitch yarn knit through said layer of nonwoven fabric and said layer of inlaid weft yarns and securing said inlaid weft yarns to said layer of nonwoven fabric, and a coating of thermoactive adhesive material on the side of the interlining fabric on which said layer of inlaid weft yarns is positioned, said coating of thermoactive adhesive material being fusible at a predetermined temperature which is lower than the temperature at which said layer of nonwoven fabric, said layer of inlaid weft yarns, said knit stitch yarn and the base fabric will be adversely affected, so that said composite interlining fabric may be fused to one side of the base fabric by the application of heat thereto, said layer of nonwoven fabric providing a barrier to prevent strike back of said adhesive coating material when said composite interlining fabric is fused to the base fabric.

2. The composite interlining fabric of claim 1 wherein said stitch yarn is knit through said layer of nonwoven fabric and said layer of inlaid weft yarns in a warp knit stitch pattern.

3. The composite interlining fabric of claim 2 wherein said warp knit construction includes a plurality of side-by-side stitch loop chains extending along the side of said layer of inlaid weft yarns opposite said layer of nonwoven fabric, and diagonally extending laps extending in a zig-zag path and interconnecting adjacent stitch loop chains, said laps being positioned on the side of said layer of nonwoven fabric opposite said layer of inlaid weft yarns.

4. The composite interlining fabric of claim 1 wherein said coating of thermoactive adhesive material comprises a plurality of randomly spaced dots of adhesive material.

5. The composite interlining fabric of claim 1 wherein said weft yarn comprises spun yarn.

6. The composite interlining fabric of claim 5 wherein said spun yarn is about 10/1 to about 30/1 cotton count yarn.

7. The composite interlining fabric of claim 6 wherein said spun yarn comprises 100% polyester fiber.

8. The composite interlining fabric of claim 1 wherein said weft yarn comprises monofilament or multifilament yarn.

9. The composite interlining fabric of claim 8 wherein said weft yarn is monofilament yarn.

10. The composite interlining fabric of claim 9 wherein said monofilament yarn is about 85 to about 550 denier.

11. A fused composite fabric comprising the composite interlining fabric of claim 1 which is thermally fused to a garment base fabric.

12. The fused composite fabric of claim 11 wherein the garment base fabric is a tightly woven fabric.

13. The fused composite fabric of claim 12 wherein the weft yarn is spun yarn.

14. The fused composite fabric of claim 12 wherein the tightly woven fabric is poplin, seersucker or pinfeather.

15. The fused composite fabric of claim 13 wherein the spun yarn is about 10/1 to about 30/1 cotton count yarn.

16. The fused composite fabric of claim 15 wherein the spun yarn comprises 100% polyester fiber.

17. The fused composite fabric of claim 11 wherein the weft yarn is monofilament or multifilament yarn.

18. The fused composite fabric of claim 11 wherein the weft yarn is monofilament yarn.

19. The fused composite fabric of claim 18 wherein the monofilament yarn is about 85 to 550 denier.

20. A method of forming a composite fusible interlining fabric adapted to be fused to a garment base fabric and having the smooth surface characteristics of nonwoven interlining fabric and the strength, bulk, resiliency and drapability characteristics of woven and knit interlining fabric, said method comprising the steps of forming a layer of nonwoven fabric of closely compacted fibers, attaching a layer of inlaid weft yarns to one side of the nonwoven fabric by knitting stitch yarn through the layer of nonwoven fabric and the layer of inlaid weft yarns, and applying a fusible coating of thermoactive adhesive material to the side of the interlining fabric to which said layer of inlaid weft yarns is attached.

21. The method of claim 20 wherein the fusible coating thermoactive adhesive material is applied in the form of randomly arranged dots.

22. The method of claim 21 wherein the layer of inlaid weft yarns is attached to the layer of nonwoven fabric by forming warp stitch loop chains of the stitch yarn.

* * * * *